US005813635A

United States Patent [19]

Fernandez

[11] Patent Number: 5,813,635

[45] **Date of Patent: *Sep. 29, 1998**

[54] TRAIN SEPARATION DETECTION

[75] Inventor: Emilio A. Fernandez, Montgomery County, Md.

[73] Assignee: Westinghouse Air Brake Company, Wilmerding, Pa.

[ * ] Notice: The term of this patent shall not extend beyond the expiration date of Pat. No. 5,738,311.

[21] Appl. No.: 979,310

[22] Filed: Nov. 26, 1997

Related U.S. Application Data

[63] Continuation-in-part of Ser. No. 799,882, Feb. 13, 1997, Pat. No. 5,738,311.

[51] Int. Cl.[6] ..... B61L 3/00

[52] U.S. Cl. ..... 246/168; 246/187 C

[58] Field of Search ..... 246/167 R, 168, 246/169 R, 187 C; 340/901; 701/19

[56] References Cited

U.S. PATENT DOCUMENTS

| | | | |
|---|---|---|---|
| 1,286,743 | 12/1918 | Ostrowski | 246/168 |
| 1,321,685 | 11/1919 | Vallaro | 246/168 |
| 1,656,689 | 1/1928 | Benn et al. | 246/168 |
| 1,918,231 | 7/1933 | Chesnutt | 246/268 |
| 5,638,276 | 6/1997 | Hart | 246/182 B |
| 5,738,311 | 4/1998 | Fernandez | 246/168 |

FOREIGN PATENT DOCUMENTS

| | | | |
|---|---|---|---|
| 2225887 | 6/1990 | United Kingdom | 246/168 |

*Primary Examiner*—S. Joseph Morano
*Attorney, Agent, or Firm*—Whitham, Curtis & Whitham

[57] ABSTRACT

A train separation detector for a distributed power control system in railroad trains and trains with an installed Electronic Control Pneumatic (ECP) brake system uses the distance traveled input from an axle drive generator or similar device to compute the speed of the lead locomotive and the speed of the remote locomotives and/or ECP brake system equipped cars and also the distance traveled by the lead locomotive and the remote locomotives and/or ECP brake system equipped cars per unit of time. Normally, both the distance traveled and the speed of the lead and remote locomotives and/or ECP brake system equipped cars will, on average, be the same since they are in the same train. If there is a separation, however, both the distance traveled and the speed of the lead and remote locomotives and/or ECP brake system equipped cars will be different to the extent that there is a train separation. By comparing the speed and distance traveled of the lead and remote locomotives and ECP brake system equipped cars, the lead locomotive will be able to detect train separation and take appropriate action.

23 Claims, 6 Drawing Sheets

TRAIN SEPARATION DETECTION

CROSS-REFERENCE TO RELATED APPLICATION

This application is a continuation-in-part application of application Ser. No. 08/799,882 filed Feb. 13, 1997, now U.S. Pat. No. 5,738,311, assigned to a common assignee herewith.

BACKGROUND OF THE INVENTION

1. Field of the Invention

The present invention generally relates to improvements in railroad control systems and, more particularly, to detection of a separation condition between cars in a train. The separation condition may occur between a lead locomotive and multiple remote locomotives in a distributed power control system or between cars having an installed radio-based Electronically Controlled Pneumatic (ECP) brake system.

2. Background Description

Distributed power control systems in railroad trains have been developed for use in trains having multiple helper or remote locomotives separated from the lead locomotive by a number of freight cars. The remote locomotives may also be separated from one another by a number of freight cars. Normally, when two locomotives are directly connected together, communication between the two locomotives for purposes of controlling the trailing locomotive from the lead locomotive is through the multiple unit or MU cable. However, when freight cars separate the locomotives, this communication link is not available.

Distributed power control systems typically include a plurality of radio frequency (RF) communication modules mounted in respective ones of the locomotives in a train. Communication between the lead locomotive to the remote locomotives is effected by a protocol of command and status messages transmitted between the communication modules.

Freight trains can be more than a mile long, and the train crew does not have complete visual contact with the total length of the train. Therefore, a train separation between the one of the remote locomotives and that portion of the train ahead of the remote locomotive could take place without the train crew observing that condition. Current distributed power systems rely on the monitoring of brake pipe pressure and brake pipe air flow to detect abnormal operating conditions, like a train separation. Existing systems rely on the fact that a train separation normally results in a separation of the brake pipe which will result in brake pipe air exhausting to atmosphere. Since existing systems monitor brake pipe pressure and brake pipe air flow, existing systems can infer a train separation condition by the changes in these parameters and take appropriate action to insure safe operation in these circumstances. Appropriate action might be alerting the operator of the condition and setting the remote locomotive throttle controls to idle.

The current systems work well except in cases when there is a blockage in the brake pipe that allows the remote locomotive to separate from the rest of the train without affecting the brake pipe pressure and air flow. Such is the case when, due either to vandalism or to operator error, one or more of the brake pipe angle cocks that are between the remote locomotive and the rest of the train are closed. This has actually happened in a case in which the remote locomotive separated from the lead locomotive and for some part of the trip until the condition was detected there was a considerable separation, on the order of miles. Such a condition can, of course, be extremely dangerous.

A similar situation can arise in radio-based Electronically Controlled Pneumatic (ECP) brake systems currently under evaluation by the Association of American Railroads (AAR). In such a system, each car in the train consist is equipped with a battery-powered, radio-based ECP brake control unit which responds to transmitted commands from the locomotive. Such trains may or may not include multiple locomotives in a distributed power control system. One of the AAR's concerns in such a system is the possibility of a saboteur closing both angle cocks at a coupling within the train and then uncoupling the train to cause a train separation. Again, for a period of time, the brake pipe pressure might not change sufficiently for the train separation to be detectable.

SUMMARY OF THE INVENTION

It is therefore an object of the present invention to provide a train separation detector for a distributed power control system in railroad trains.

It is another object of the invention is provide a train separation detector which is operable in ECP brake system equipped trains.

According to the invention, the lead locomotive and the remote locomotives use the distance traveled input from an axle drive generator or similar device to compute the speed of the lead locomotive and the speed of the remote locomotives and also the distance traveled by the lead locomotive and the remote locomotives per unit of time. Of course, both the distance traveled and the speed of the lead and remote locomotives will, on average, be the same since they are in the same train. If there is a separation, however, both the distance traveled and the speed of the lead and remote locomotives will be different to the extent that there is a train separation. By comparing the speed and distance traveled of the lead and remote locomotives, the distributed power system will be able to detect train separation and take appropriate action. In an ECP brake system equipped train, at least the last car but preferably each car in the train is equipped with an axle drive generator or similar device to compute the speed of the car. When the speed differential between any two cars reaches a specified level, the entire train will be commanded to go to emergency.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF PREFERRED EMBODIMENTS OF THE INVENTION

Figure 1:
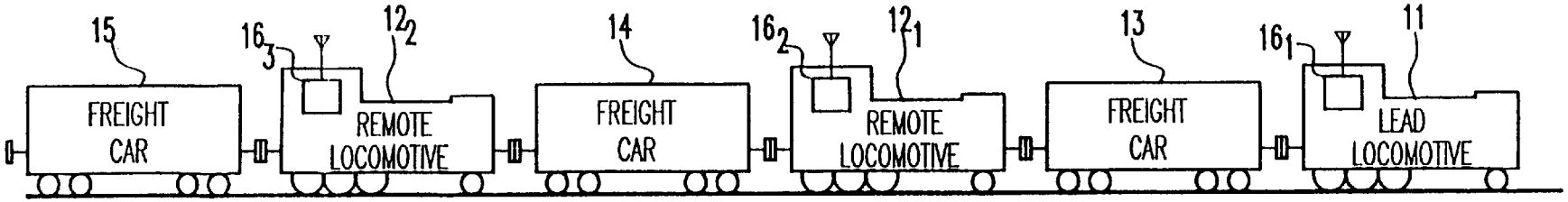
FIG. 1 is a block diagram of a distributed power control system of the type on which the invention may be implemented.

Referring now to the drawings, and more particularly to FIG. 1, there is shown a train which includes a lead locomotive 11 and multiple remote locomotives $\mathbf{12}_1$ and $\mathbf{12}_2$ separated by a plurality of freight cars 13, 14 and 15. Each of the locomotives 11, $\mathbf{12}_1$ and $\mathbf{12}_2$ are equipped with an RF communication and control module, generally shown as $\mathbf{16}_1$, $\mathbf{16}_2$ and $\mathbf{16}_3$. The communication and control module $\mathbf{16}_1$ of the lead locomotive is programmed to act as the lead unit, and the communication and control modules $\mathbf{16}_2$ and $\mathbf{16}_3$ of the remote locomotives being programmed to act as remote units for purposes of the distributed power control protocol. These are interchangeable so that if, for example, remote locomotive $\mathbf{12}_1$ were to be used as the lead locomotive in another train, its communication and control module $\mathbf{16}_2$ could be appropriately programmed to act as the lead unit for that train.

Figure 2:
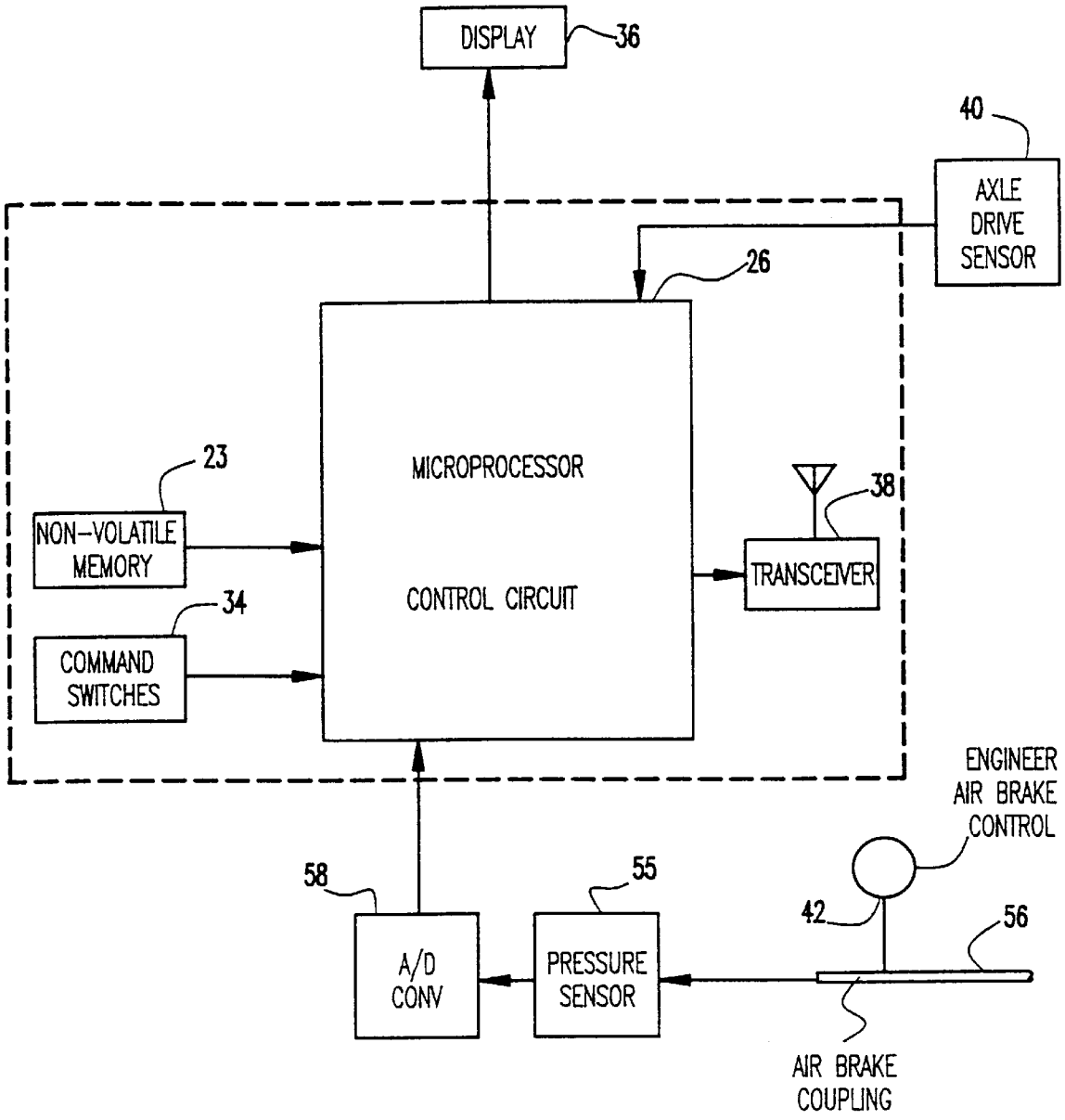
FIG. 2 is a block diagram of the basic components of a communications module as mounted in each of the lead and remote locomotives of the distributed power control system.

The locomotive control and communication module is shown in FIG. 2 and includes microprocessor control circuit 26 and a nonvolatile memory 28 which stores the control program for the microprocessor control circuit. In addition to nonvolatile memory 28, the microprocessor control circuit 26 also has a command switch input 34 and provides outputs to a display 36 and transceiver 38.

A locomotive engineer controls air brakes via the normal locomotive air brake controls, indicated schematically at 42, and the normal air brake pipe 56 which extends the length of the train. Existing communication and control modules are connected to the locomotive's axle drive via an axle drive sensor 40 which provides typically twenty pulses per wheel revolution. Based on this input, the microprocessor driven control circuit 26 computes the locomotive's speed and distance traveled.

In addition, there is typically a pressure sensor 55 to which is coupled to the brake pipe 56 at the locomotive and generates an electrical signal proportional to pressure. The output of pressure sensor 55 is coupled to an analog to digital converter 58 which generates a digital signal to the microprocessor control circuit 26 so that changes in brake pressure at the locomotive end of the brake pipe are coupled to the microprocessor control circuit 26.

According to the present invention, the remote locomotives transmit as part of their status messages their computed speed and distance traveled. The computation of both speed and distance traveled is averaged over a short predetermined time to account for naturally occurring variations due to slack or take up of slack in the train. In addition, prior to the regular computation and transmission of this information, each locomotive, including the lead locomotive, a calibration procedure must be completed. Such a calibration procedure is routine and takes into account the fact that locomotive wheels have differing diameters due to wear and machining. In the case of an ECP brake system equipped train, an "automatic" calibration procedure could be implemented, for example, by the master controller in the locomotive sending a signal to all the cars to start accumulating distance and another signal to stop accumulating. The master controller would then provide the cars with a distance computed by the master controller, and this distance would be used by the cars to make their respective calibrations.

Figure 3:
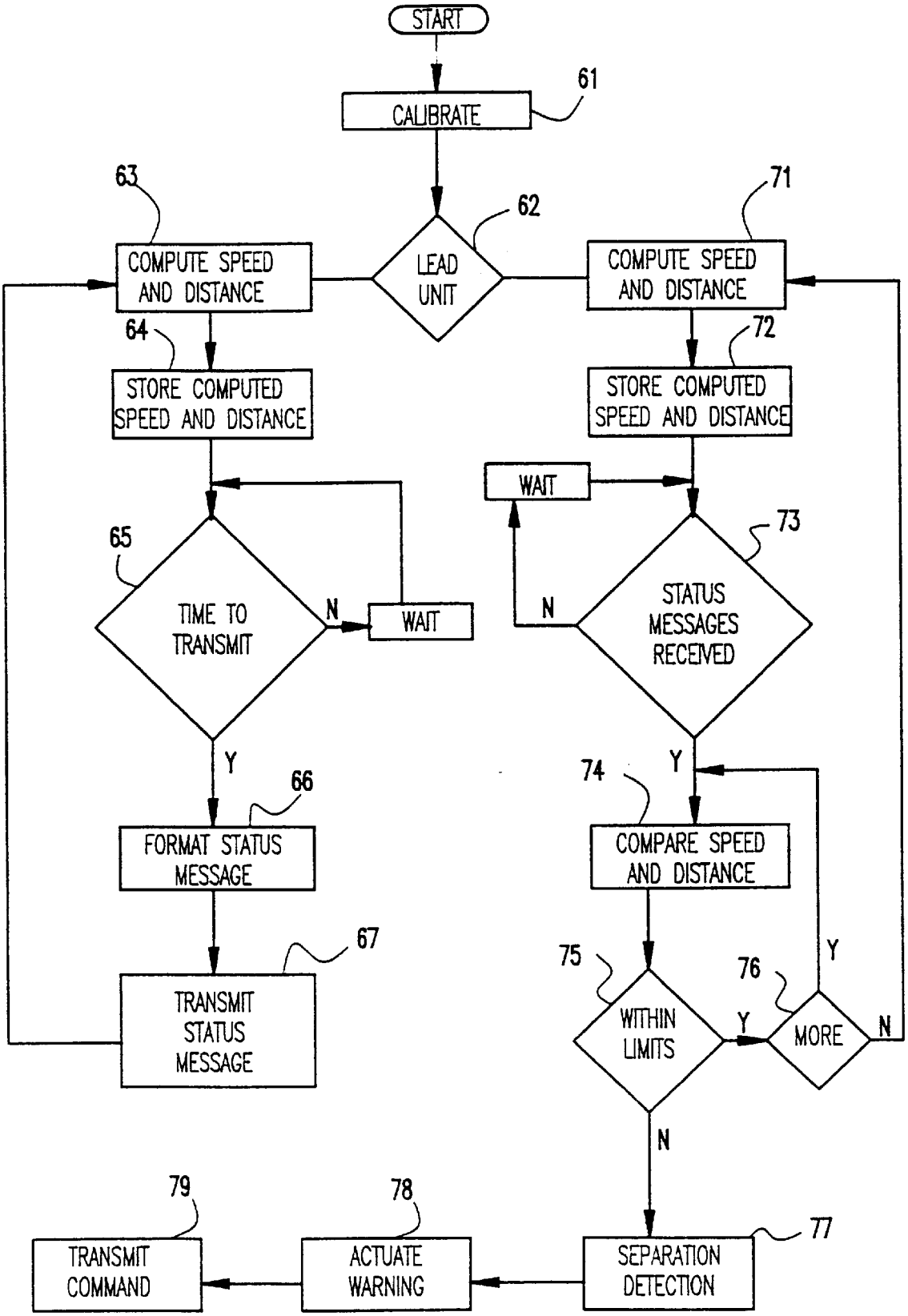
FIG. 3 is a flow diagram illustrating the logic of the train separation detector according to the invention.

The flow diagram of the logic for the train separation detector is shown in FIG. 3. The process begins by performing the calibration procedure in function block 61. Once calibrated, a test is made in decision block 62 to determine whether this communication and control unit is programmed as the lead unit or the remote unit. If programmed as the remote unit, a computation of current speed and distance traveled is made in function block 63. The computed speed and distance traveled data is stored in function block 64, and a test is made in decision block 65 to determine if it is time to transmit a status message. Such a message may be transmitted either periodically or in response to a command message from the lead unit. When it is time to transmit a status message, the stored speed and distance traveled data is formatted in the status message in function block 66, and the status message is transmitted to the lead unit in function block 67. At this point, the process loops back to function block 63 to again compute the current speed and distance traveled.

If the communication and control unit is programmed as the lead unit, as determined in decision block 62, then a computation of current speed and distance traveled is made in function block 71, and the computed speed and distance traveled data is stored in function block 72. A test is made in decision block 73 to determine if the status messages have been received from the remote locomotives. When the status messages have been received, the speed and distance traveled data from each remote locomotive is extracted from the status messages. The stored speed and distance traveled for the lead locomotive is compared in turn with each of the speed and distance traveled data extracted from the status messages in function block 74. A test is made after each comparison in decision block 75 to determine if the comparison is within predefined limits. If so, a determination is made in decision block 76 to determine if another comparison is to be made and, if so, the process loops back to function block 74; otherwise, the process loops back to function block 71 to compute the current speed and distance traveled. If, however, one of the comparisons is not within limits as determined in decision block 75, a separation condition is detected in function block 77. As a result, the operator of the lead locomotive is alerted by means of visible and/or audible warning in function block 78. A status message may also be displayed on display 36 (FIG. 2). Appropriate action may then be taken. This may take the form of transmitting a command message in function block 79 to the remote locomotive(s) which follow the separation in the train to set their throttle controls to idle and applying the brakes of the trailing separated portion of the train. This will allow the leading separated portion of the train to independently and safely stop and reverse to make the connection to the trailing portion of the train without the possibility of a collision between the two portions.

The preferred embodiment of the invention may be modified to compare only speed or only distance traveled of the lead and remote locomotives. This would have the advantage of minimizing the additional information transmitted in the status message and, if only speed is computed, minimizing the computation time of the microprocessor control circuits.

Figure 4:
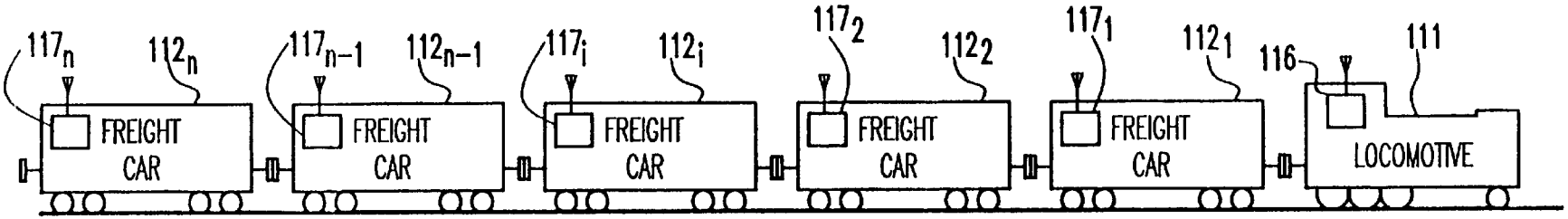
FIG. 4 is a block diagram of an ECP brake system equipped train of the type on which the invention may be implemented.

The same principles described above for the distributed power control system are applicable to an ECP brake system equipped train which may only have a single locomotive, as generally shown in FIG. 4. FIG. 4 shows a train which includes a lead locomotive 111 and a plurality of freight cars $\mathbf{112}_1, \mathbf{112}_2, \ldots, \mathbf{112}_n$. In this train, there may or may not be multiple remote locomotives separated by freight cars in a distributed power control system as illustrated in FIG. 1. The locomotive 11 is equipped with an RF communication and control module, generally shown as 116, and at least the last car and preferably each car of the train is equipped with an RF communication and control module $\mathbf{117}_1, \mathbf{117}_2, \ldots,$ $117_n$. The communication and control module 116 is essentially the same as that shown in FIG. 2. An ECP brake control and communication module $117_i$ is shown in FIG. 5 and is similar to the communication module 116.

Figure 5:
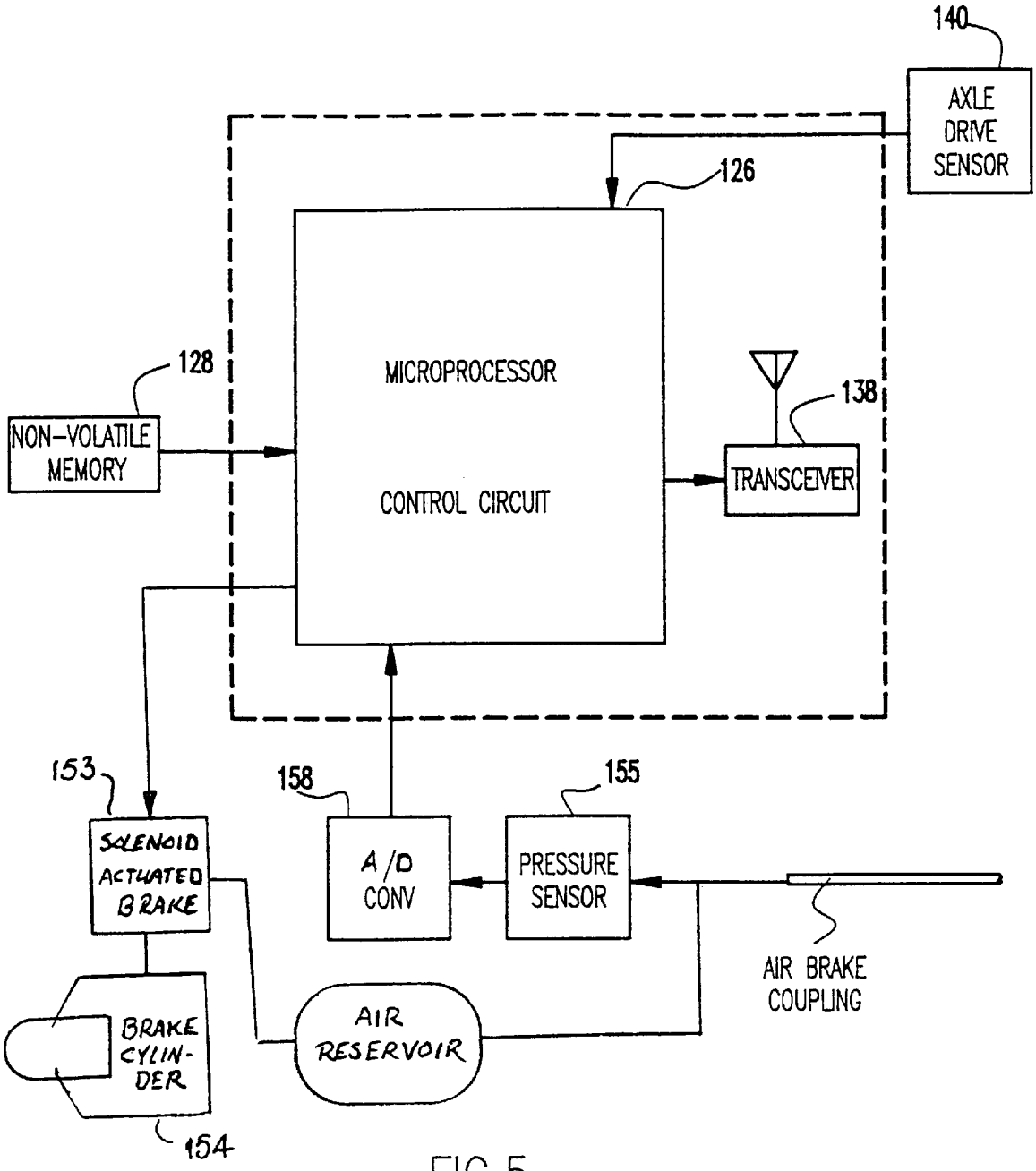
FIG. 5 is a block diagram of the basic components of an ECP brake system module as mounted on a car in the train of FIG. 4.

With reference now to FIG. 5, the ECP brake control and communication module $117_i$ includes microprocessor control circuit 126 and a nonvolatile memory 128 which stores the control program for the microprocessor control circuit. The microprocessor control circuit 126 receives digital input representing air brake pipe pressure from analog-to-digital converter 158 which converts the output of pressure sensor 155 connected to the air brake coupling. This information can be used, as in end-of-train systems, to generate an emergency condition.

In addition to microprocessor control circuit 126 and nonvolatile memory 128, the communication module $117_i$ also has a transceiver 138. Brake control signals are transmitted from the module 116 mounted in the locomotive 111. These control signals are received by the transceiver 138, demodulated and provided to the microprocessor control circuit 126. The microprocessor control circuit 126 decodes the demodulated control signals and generates the appropriate command signals to the solenoid actuated brake 153 which, in turn, controls the brake cylinder 154. Depending on the specific implementation, the brake pipe pressure information input from A/D converter 158 can be used as a feedback signal in controlling the brake cylinder 154.

The The ECP control and communication module $117_i$ according to the present invention is also connected to an axle drive sensor 140, or similar device for detecting speed. An axle drive sensor typically provides twenty pulses per wheel revolution. Based on this input, the microprocessor driven control circuit 126 computes the car's speed and distance traveled. In one embodiment of the present invention, the freight cars in the train equipped with ECP brake control and communication modules transmit as part of their status messages their computed speed and distance traveled. The computation of both speed and distance traveled is averaged over a short predetermined time to account for naturally occurring variations due to slack or take up of slack in the train. In an alternative embodiment, the locomotive transmits speed and/or distance traveled, and the cars check their computation against this information. If there is a significant deviation, the car would transmit an emergency message to the locomotive. This approach has the advantage of limiting the transmitting time of battery powered units on the cars, thus conserving battery power. This approach also has the advantage of an "automatic" or self-calibration at each of the cars, as described above.

Figure 6:
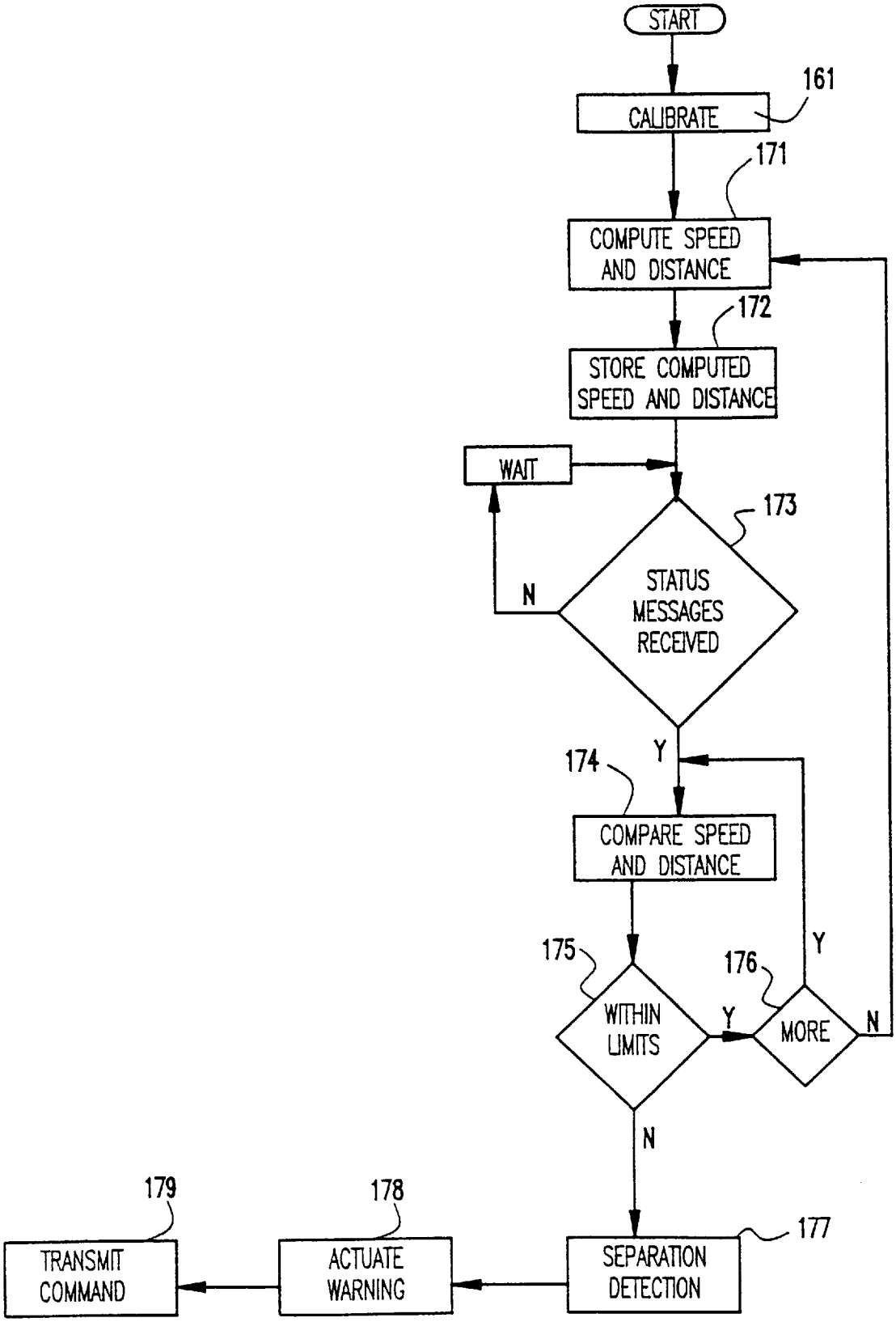
FIG. 6 is a flow diagram illustrating the logic of the train separation detector according to the invention as applied to an ECP brake system equipped train.

The flow diagram of the logic for the train separation detector is shown in FIG. 6. The process at an ECP brake system equipped car is essentially that of remote locomotive as described with respect to FIG. 3. That is, in FIG. 3, that portion of the flow diagram with reference numerals 63 to 67 is the process at and ECP brake system equipped car. Thus, FIG. 6 illustrates the process implemented in module 116 at the locomotive 111.

The process begins by performing the calibration procedure in function block 161. As described above, the calibration procedure can be a self-calibration procedure in which the locomotive transmit speed and/or distance traveled and the cars checks this information against their own calculations. Once calibrated, a computation of current speed and distance traveled of the locomotive is made in function block 171, and the computed speed and distance traveled data is stored in function block 172. A test is made in decision block 173 to determine if the status messages have been received from ECP brake system equipped cars in the train. When the status messages have been received, the speed and distance traveled data from each ECP brake system equipped car is extracted from the status messages. The stored speed and distance traveled for the locomotive is compared in turn with each of the speed and distance traveled data extracted from the status messages in function block 174. A test is made after each comparison in decision block 175 to determine if the comparison is within predefined limits. If so, a determination is made in decision block 176 to determine if another comparison is to be made and, if so, the process loops back to function block 174; otherwise, the process loops back to function block 171 to compute the current speed and distance traveled. If, however, one of the comparisons is not within limits as determined in decision block 175, a separation condition is detected in function block 177. As a result, the operator of the locomotive is alerted by means of visible and/or audible warning in function block 178. A status message may also be displayed on display 36 (FIG. 2). Appropriate action may then be taken. This may take the form of transmitting an emergency command message in function block 179.

In a alternative embodiment where the locomotive transmits the speed and distance information, the steps in blocks 174, 175 and 177 are performed at each of the cars. If a separation is detected, that information is transmitted as an emergency message to the locomotive which actuates the warning in function block 178.

A further refinement to the system may be made to account for the possibility of an undesired emergency brake application if a wheel with an axle generator slides and locks up during a normal brake application. For example, if the last car of the train is within speed and distance traveled limits, it may be safely concluded that a train separation has not occurred. As in the first embodiment, the information transmitted and compared may be only speed or only distance.

While the invention has been described in terms of preferred embodiments, those skilled in the art will recognize that the invention can be practiced with modification within the spirit and scope of the appended claims.

Having thus described my invention, what I claim as new and desire to secure by letters patent is as follows:

1. A railroad train separation detector comprising:

a first communication and control unit in a locomotive of the railroad train, said first communication and control unit including a first microprocessor control circuit and a first transceiver, the first microprocessor control circuit periodically computing speed for the locomotive and the first transceiver transmitting and receiving messages to and from remote units in the train;

a second communication and control unit in a remote unit of the railroad train, the second communication and control unit including a second microprocessor control circuit and a second transceiver, the second microprocessor control circuit periodically computing speed for the remote unit; and means at one of the first and second communication and control units for comparing speed computed by the first and second microprocessor units and, if the comparison is not within predetermined limits, declaring a train separation.

2. The railroad train separation detector as recited in claim 1 wherein the second transceiver periodically transmits computed speed of the remote unit as a part of status messages to the first transceiver and the first microprocessor control circuit of the first communication and control unit compares a speed received in a status message from the remote unit with the computed speed of the locomotive.

3. The railroad train separation detector as recited in claim 1 wherein the first transceiver periodically transmits computed speed of the locomotive to the second transceiver and the second microprocessor control circuit of the second communication and control unit compares a speed received from the locomotive with the computed speed of the remote unit, and if a train separation is declared, transmitting an emergency condition to the locomotive.

4. The railroad train separation detector as recited in claim 1 wherein the first microprocessor control circuit additionally computes distance traveled for the locomotive, the second microprocessor additionally computes distance traveled for the remote unit, and the means for comparing additionally comparing distance computed by the first and second microprocessor units and, if the comparison is not within predetermined limits, declaring a train separation.

5. The railroad train separation detector as recited in claim 4 wherein the computed distance traveled for the remote unit is transmitted in a status message to the locomotive, and the distance traveled received in the status message from the remote unit is compared by the first microprocessor control circuit with the computed distance traveled of the locomotive.

6. The railroad train separation detector as recited in claim 4 wherein the computed distance traveled for the locomotive is transmitted to the remote unit, and the distance traveled received from the locomotive unit is compared by the second microprocessor control circuit with the computed distance traveled of the remote unit, and if a train separation is declared, transmitting an emergency condition to the locomotive.

7. The railroad train separation detector as recited in claim 1 wherein in the train having an installed Electronically Controlled Pneumatic (ECP) brake system and said remote unit is a car in the train, said second communication and control unit being part of the ECP brake system.

8. The railroad train separation detector as recited in claim 1 further comprising means for detecting speed at each of the locomotive and remote unit.

9. The railroad train separation detector as recited in claim 8 wherein the means for detecting speed is an axle generator connected to an axle of the car for generating an output signal proportional to a speed of rotation of the axle and wherein said second communication and control unit computes a speed of the car based on the output signal from the axle generator.

10. A railroad train separation detector for an Electronically Controlled Pneumatic brake system equipped train comprising:

a first communication and control unit in a locomotive of the railroad train, said first communication and control unit including a first microprocessor control circuit and a first transceiver, the first microprocessor control circuit periodically computing speed for the locomotive and the first transceiver transmitting and receiving messages to and from ECP brake system equipped cars in the train;

a second communication and control unit in an ECP brake system equipped car of the railroad train, the second communication and control unit including a second microprocessor control circuit and a second transceiver, the second microprocessor control circuit periodically computing speed for the ECP brake system equipped car; and means at one of the first and second communication and control units for comparing speed computed by the first and second microprocessor units and, if the comparison is not within predetermined limits, declaring a train separation.

11. The railroad train separation detector recited in claim 10 wherein the second transceiver periodically transmitting computed speed of the ECP brake system equipped car as a part of status messages to the first transceiver and the first microprocessor control circuit of the first communication and control unit compares a speed received in a status message from the ECP brake system equipped car to the computed speed of the locomotive.

12. The railroad train separation detector recited in claim 10 wherein the first transceiver periodically transmits computed speed of the locomotive to the second transceiver and the second microprocessor control circuit of the second communication and control unit compares a speed received from the locomotive with the computed speed of the ECP brake system equipped car, and if a train separation is declared, transmits an emergency condition to the locomotive.

13. The railroad train separation detector as recited in claim 10 wherein the first microprocessor control circuit additionally computes distance traveled for the locomotive, the second microprocessor additionally computes distance traveled for the ECP brake system equipped car, and the means for comparing additionally compares distance computed by the first and second microprocessor units and, if the comparison is not within predetermined limits, declaring a train separation.

14. The railroad train separation detector as recited in claim 13 wherein the computed distance traveled for the ECP brake system equipped car is transmitted in a status message to the locomotive, and the distance traveled received in the status message from the ECP brake system equipped car is compared by the first microprocessor control circuit with the computed distance traveled of the locomotive.

15. The railroad train separation detector as recited in claim 13 wherein the computed distance traveled for the locomotive is transmitted to the ECP brake system equipped car, and the distance traveled received from the locomotive unit is compared by the second microprocessor control circuit with the computed distance traveled of the ECP brake system equipped car, and if a train separation is declared, transmitting an emergency condition to the locomotive.

16. The railroad train separation detector as recited in claim 10 further comprising means for detecting speed at each of the locomotive and ECP brake system equipped car.

17. The train separation detector as recited in claim 16 wherein the means for detecting speed are axle generators connected to axles of the locomotive and the ECP brake system equipped car for generating output signals proportional to a speed of rotation of the respective axles.

18. A method of detecting a train separation condition in a railroad train having an installed Electronic Control Pneumatic (ECP) brake system comprising the steps of:

periodically computing at a locomotive of the railroad train speed for the locomotive;

periodically computing at an ECP brake system equipped car of the railroad train speed for the ECP brake system equipped car;

comparing the computed speed for the ECP brake system equipped car with the computed speed for the locomotive;

determining if the compared speed for the ECP brake system equipped car and the locomotive are within predetermined limits; and if not within predetermined limits, declaring a train separation.

19. The method of detecting a train separation condition as recited in claim 18 further comprising the steps of:

storing the computed speed for the locomotive; and transmitting the speed for the ECP brake system equipped car to the locomotive, wherein the step of comparing is performed at the locomotive.

20. The method of detecting a train separation condition as recited in claim 18 further comprising the steps of:

storing the computed speed for the ECP brake system equipped car;

periodically transmitting the speed for the locomotive to the ECP brake system equipped car, wherein the step of comparing is performed at the ECP brake system equipped care; and if a train separation is declared, transmitting an emergency condition from the ECP brake system equipped car to the locomotive.

21. The method of detecting a train separation condition as recited in claim 18 further comprising the steps of:

computing distance traveled for the locomotive;

computing distance traveled for the ECP brake system equipped car;

comparing the computed distance traveled for the ECP brake system equipped car with the computed distance traveled for the locomotive; and, if the comparison is not within predetermined limits, declaring a train separation.

22. The method of detecting a train separation condition as recited in claim 21 further comprising the step of transmitting the computed distance traveled for the ECP brake system equipped car to the locomotive, wherein the step of comparing computed distance is performed at the locomotive.

23. The method of detecting a train separation condition as recited in claim 21 further comprising the steps of:

periodically transmitting the computed distance for the locomotive to the ECP brake system equipped car, wherein the step of comparing computed distance is performed at the ECP brake system equipped car; and if a train separation is declared, transmitting an emergency condition from the ECP brake system equipped car to the locomotive.

* * * * *